US007717669B2

(12) United States Patent
Sheath et al.

(10) Patent No.: US 7,717,669 B2
(45) Date of Patent: May 18, 2010

(54) LOAD ABSORPTION ARRANGEMENTS FOR GAS TURBINE ENGINES

(75) Inventors: Michael J. Sheath, Nottingham (GB); Paul S. McCabe, Tamworth (GB)

(73) Assignee: Rolls-Royce PLC, London (GB)

( * ) Notice: Subject to any disclaimer, the term of this patent is extended or adjusted under 35 U.S.C. 154(b) by 791 days.

(21) Appl. No.: 11/104,576

(22) Filed: Apr. 13, 2005

(65) Prior Publication Data

US 2005/0254938 A1 Nov. 17, 2005

(30) Foreign Application Priority Data

May 14, 2004 (GB) ..... 0410903.9

(51) Int. Cl.
*F01D 17/16* (2006.01)

(52) U.S. Cl. ..... 415/119; 415/150; 415/160; 415/162; 188/313; 188/318; 188/322.13; 267/34; 267/64.17

(58) Field of Classification Search ..... 415/119, 415/150, 159–166; 188/313, 318, 322.13, 188/322.5; 267/34, 64.16, 64.17; 91/437; 92/131, 135

See application file for complete search history.

(56) References Cited

U.S. PATENT DOCUMENTS 1,078,060 A * 11/1913 Newman ..... 188/318
1,487,524 A * 3/1924 Bambach ..... 188/313
2,827,186 A * 3/1958 Waite ..... 188/313
3,458,118 A * 7/1969 Burge et. al. ..... 415/160
3,861,822 A * 1/1975 Wanger ..... 415/162
4,695,220 A 9/1987 Dawson
4,973,077 A * 11/1990 Kuwayama et al. ..... 188/318
5,044,879 A 9/1991 Farrar
5,161,822 A * 11/1992 Lund ..... 92/131
5,286,013 A * 2/1994 Seymour et al. ..... 267/220
6,966,412 B2 * 11/2005 Braswell et al. ..... 188/313
2004/0074720 A1 * 4/2004 Thieltges ..... 188/318

FOREIGN PATENT DOCUMENTS

GB 609008 9/1948
GB 615549 1/1949

* cited by examiner

*Primary Examiner*—Christopher Verdier
(74) *Attorney, Agent, or Firm*—Oliff & Berridge, PLC

(57) ABSTRACT

A load absorption arrangement 40 for absorbing loads in a variable stator vane positioning system of a gas turbine engine includes a valve 42 which has a first operating condition to enable the load absorption arrangement 40 to transmit load, and a second operating condition, which is operable above a predetermined load, in which the valve 42 can release to enable the load absorption arrangement 40 to absorb the load thereon. The arrangement 40 is particularly suitable for absorbing shock loads which may arise under engine surge.

17 Claims, 3 Drawing Sheets

LOAD ABSORPTION ARRANGEMENTS FOR GAS TURBINE ENGINES

The present invention relates to load absorption arrangements for use in gas turbine engines. The invention also relates to variable stator vane positioning systems including load absorption arrangements.

Variable stator vanes are used in gas turbine engines to control airflow through a multi-stage compressor. In the event of breakdown of airflow through the compressor, a condition known as 'surge' can occur in which high pressure air is expelled from the combustor into the compressor stages, thereby causing a sudden reversal of the airflow through the compressor and a resultant sudden loss of engine thrust.

Under surge conditions, the reversed airflow can impart a significant shock load onto the variable stator vanes, inducing rotational vibration. Most of this shock load is transmitted to the stator vane positioning system, the components of which may be damaged as a result. It would be desirable to reduce the likelihood of such damage occurring in such situations and/or similar situations.

According to a first aspect of the present invention, there is provided a load absorption arrangement for absorbing loads in a variable stator vane positioning system, the arrangement comprising a release means having a first operating condition to enable the load absorption arrangement to transmit load, and a second operating condition operable above a predetermined load in which the release means can release to enable the load absorption arrangement to absorb the load thereon.

The release means may comprise a fluid containment housing which may contain a fluid. The release means may comprise a valve which may be in a closed position when the release means is in the first operating condition, and may be in an open position when the release means is in the second operating condition. The valve may be operable to retain the fluid within the housing when the release means is in the first operating condition, and may be operable to release the fluid from the housing when the release means is in the second operating condition. The fluid may be an incompressible fluid.

The release means may comprise a fluid displacement member for displacing the fluid. The fluid displacement member may be operable to displace the fluid when the release means is in the second operating condition, and may be operable to displace the fluid from the housing.

The fluid displacement member may divide the fluid containment housing into first and second fluid containment compartments. When the release means is in the second operating condition, the fluid displacement member may be operable to displace the fluid between the compartments. The fluid displacement member may be a piston.

The release means may include a fluid transfer conduit, which may extend between the first and second fluid containment compartments. The fluid transfer conduit may include the valve.

The release means may include positioning means which may locate the arrangement in a predetermined position when the release means is in the first operating condition. The positioning means may comprise a resilient means which may be locatable within the fluid containment housing.

The resilient means may include a resilient member which may be located within the first fluid containment compartment and may be operable between the fluid containment housing and the fluid displacement member to bias the fluid displacement member in first direction. The resilient means may include a further resilient member which may be located within the second fluid containment compartment and may be operable between the fluid containment housing and the fluid displacement member to bias the fluid displacement member in a second direction, which may be opposite to the first direction.

The resilient member and further resilient member may abut respectively opposite surfaces of the fluid displacement member. The respective stiffness of the resilient members may define the predetermined position of the arrangement when the release means is in the first operating condition. The resilient member and further resilient member may each comprise a spring.

According to a second aspect of the present invention, there is provided a variable stator vane positioning system for use in a gas turbine engine, the system including a load absorption arrangement for absorbing shock loads within the system.

The load absorption arrangement may be as described above.

The system may include a control rod which may comprise the load absorption arrangement. The system may include an actuator which may comprise the load absorption arrangement.

According to a third aspect of the present invention, there is provided a gas turbine engine including a variable stator vane positioning system as described above.

Embodiments of the present invention will now be described by way of example only and with reference to the accompanying drawings, in which:—

Figure 2:
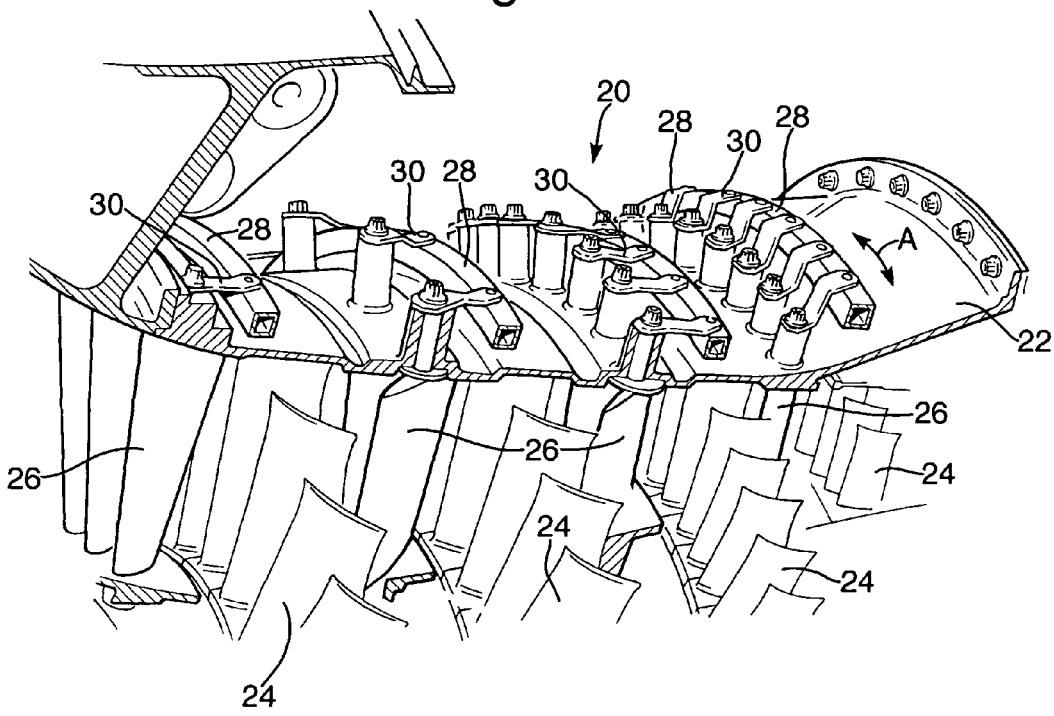
FIG. 2 is a detailed view of a compressor section of the gas turbine engine of FIG. 1.
Figure 2A:
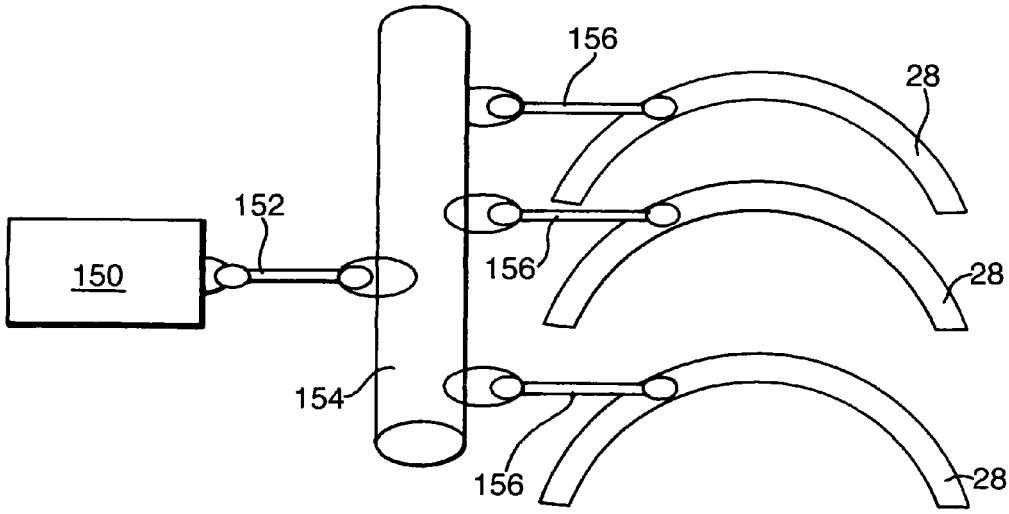
Figure 3:
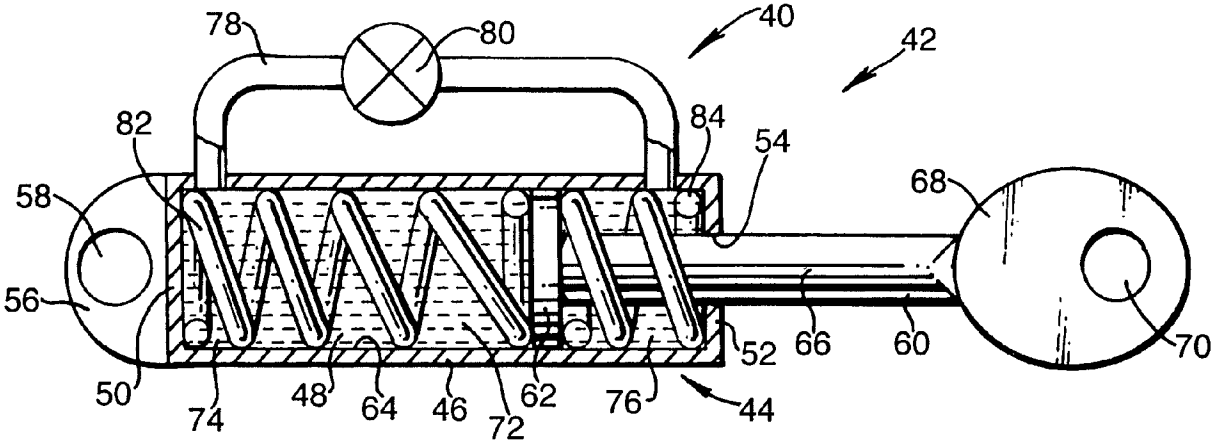
Figure 4:
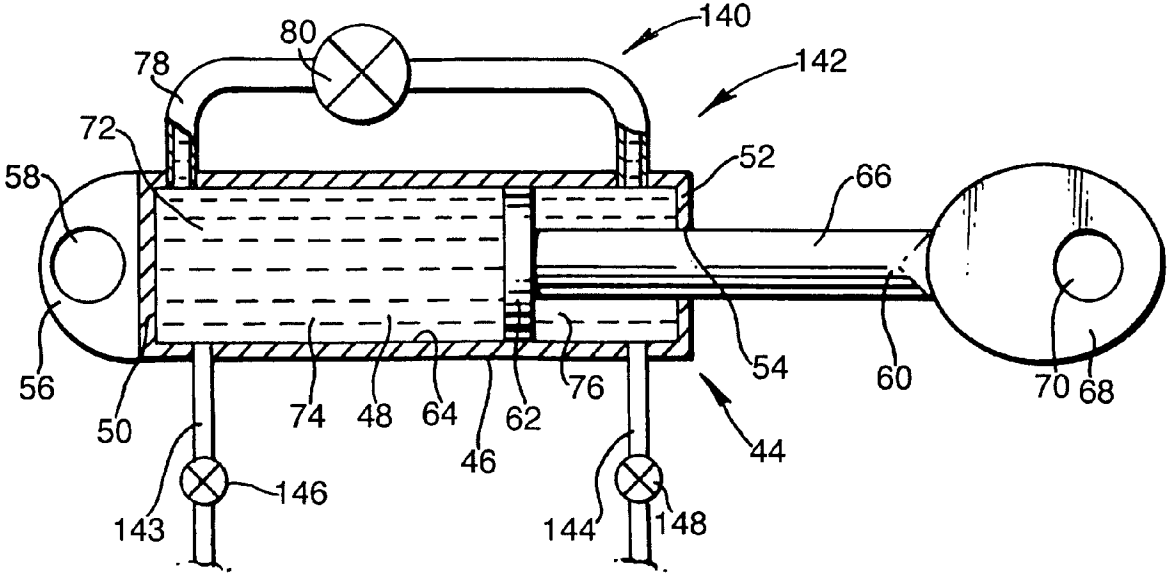

FIG. 2*a* is a diagrammatic view of a stator vane positioning system;

FIG. 3 is a diagrammatic cross-sectional view of a load absorption arrangement; and FIG. 4 is a diagrammatic cross-sectional view of a modified load absorption arrangement.

Figure 1:
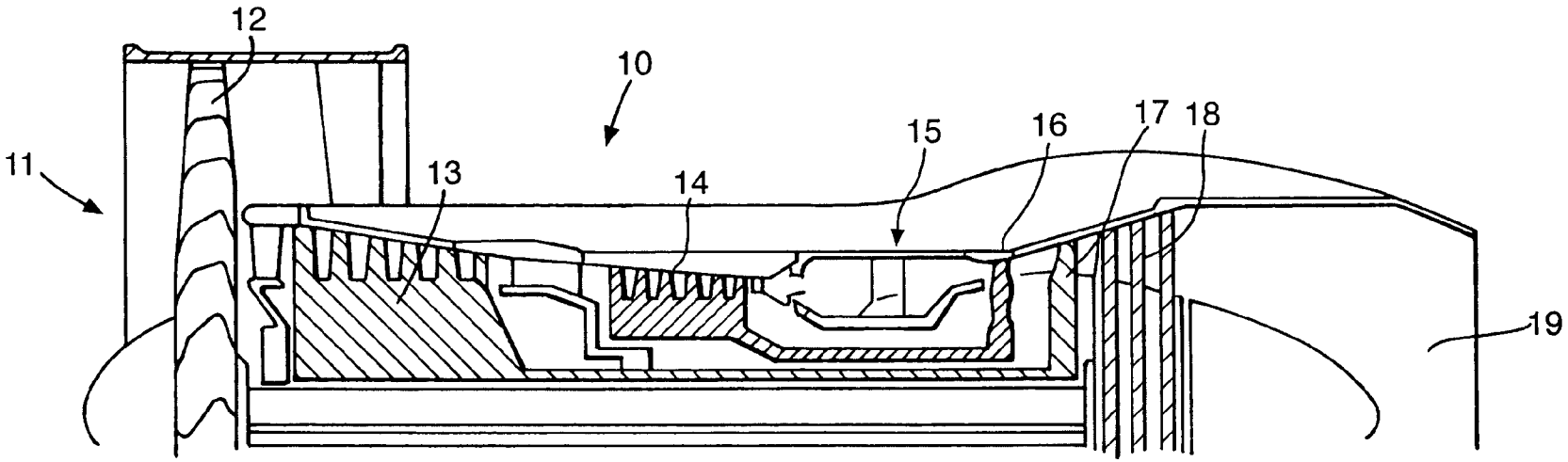
FIG. 1 is a diagrammatic cross-sectional view of a part of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13, and the fan 12 by suitable interconnecting shafts.

Referring to FIG. 2, the compressor section 20 of the gas turbine engine 10 comprises a casing 22 and a plurality of sets of rotor blades 24 mounted for rotation about a longitudinal axis of the compressor 20. Upstream of each set of rotor blades 24 is mounted a set of variable stator vanes 26, each rotatably mounted in the casing 22.

A stator vane actuator ring 28 extends circumferentially around the outside of the casing 22 adjacent to each set of stator vanes 26. Each stator vane 26 is mechanically connected to an adjacent actuator ring 28 by a variable stator vane actuating lever 30.

Each actuator ring 28 is circumferentially rotatable in either direction about the longitudinal axis of the compressor 20, as indicated by arrow A. This is achieved by use of a stator vane positioning system (see FIG. 2*a*) which comprises an actuator 150, an actuator control linkage 152 which transmits movement from the actuator to a crankshaft 154, and a plurality of control rods 156 each connected at one end to the crankshaft 154 and at the other end to a respective actuator ring 28. When the stator vane positioning system is operated, movement is transmitted from the actuator 150 via the actuator control linkage 152 to the crankshaft 154, which is caused to rotate. This rotational movement is transmitted by each control rod 156 to a respective actuator ring 28. Rotational movement of an actuator ring 28 is then transmitted by each of the plurality of actuating levers 30 to the respective set of variable stator vanes 26, causing them to rotate.

Referring to FIGS. 3 and 4, there is shown a load absorption arrangement 40, 140 for absorbing loads, such as shock loads, in a variable stator vane positioning system of a gas turbine engine. The arrangement 40, 140 comprises generally a release means 42, 142 having a first operating condition to enable the load absorption arrangement 40, 140 to transmit load, and a second operating condition, which is operable above a predetermined load, in which the release means 42, 142 can release to enable the load absorption arrangement 40, 140 to absorb the load thereon.

In more detail and referring to FIG. 3, the release means 42 comprises a fluid containment housing 44 which is generally cylindrical and has an annular wall 46 defining a bore 48. The housing 44 includes a first end 50 which is closed and a second end 52 which includes a centrally located aperture 54. The first end 50 includes an attachment member 56 to enable the load absorption arrangement 40 to be incorporated into a stator vane positioning system, as will be described in more detail hereinafter. The attachment member 56 includes an aperture 58 for receiving a fastener or other suitable means for securing the arrangement 40 in position.

The release means 42 further comprises a displacement member in the form of a piston arrangement 60, part of which is located within the housing 44 for slidable movement within the housing 44 in the longitudinal direction between the first and second ends 50, 52. The piston arrangement 60 is of generally conventional construction and includes a piston, which may be in the form of a disc 62, which engages an inner surface 64 of the annular wall 46 to create a fluid tight seal between the inner surface 64 and the disc 62. The piston arrangement 60 also includes an elongate rod 66 which extends through the aperture 54, a fluid tight seal being created between the elongate rod 66 and the aperture 54.

An attachment member 68 is provided at the distal end of the rod 66 which, in combination with the attachment member 56, enables the arrangement 40 to be incorporated into a stator vane positioning system, as will be described hereinafter. The attachment member 68 includes an aperture 70 for receiving a fastener or other means suitable for securing the arrangement 40 in position.

The housing 44 contains an incompressible fluid 72, such as oil, and the disc 62 divides the housing 44 into first and second fluid containment compartments 74, 76 such that a portion of the fluid 72 is retained within the first compartment 74 and a portion in the second compartment 76. The release means 42 includes a conduit 78 which extends between the first and second compartments 74, 76 to enable transfer of the incompressible fluid 72 between the compartments 74, 76, and hence sliding movement of the disc 62 within the housing 52, when the release means 40 is in the second operating condition.

The release means 42 also includes a valve 80 which is operable between a closed position in which it prevents transfer of the incompressible fluid 72 between the compartments 74, 76, and hence prevents movement of the disc 62, and an open position in which it permits transfer of the incompressible fluid 72 between the compartments 74, 76, and hence allows movement of the disc 62.

The release means 42 further includes resilient positioning means in the form of first and second springs 82, 84 which are operable to locate the arrangement 40 in a predetermined position when the release means 42 is in the first operating condition. The first spring 82 is located in the first fluid containment compartment 74 and abuts respectively the first end 50 of the housing 44 and the disc 62, such that the first spring biases the disc 62 in a first direction away from the first end 50. The second spring 84 is located in the second fluid containment compartment 76 and abuts respectively the second end 52 of the housing and the disc 62, such that the second spring 84 biases the disc 62 in a second direction, opposite to the first direction, towards the first end 50 of the housing 44.

The respective stiffness of each spring 82, 84 determines the equilibrium resting position of the disc 62 within the housing 44 and appropriate spring stiffnesses are chosen depending upon the desired predetermined position of the disc 62.

In use, the arrangement 40 is incorporated into a stator vane positioning system of the gas turbine engine 10 to enable the absorption of loads, for example shock loads which may arise due to engine surge, within the system. The arrangement 40 may be incorporated into, or constitute, the actuator control linkage which connects the actuator to the crankshaft, as described above, so that the arrangement 40 is able to absorb load transmitted from any of the stator vane actuator rings 28. Alternatively or additionally, the arrangement 40 may be incorporated into, or constitute, each of the control rods which connect the crankshaft to a respective stator vane actuator ring. In both cases, the manner of operation of the arrangement 40 is the same and is described below.

During normal operation of the engine 10, when the stator vane positioning system is subjected to normal loading, the release means 42 is in the first operating condition so that the arrangement 40 can transmit load from the actuator to each of the stator vane actuator rings 28 to enable the stator vanes 26 to be set to a desired angular position. In the first operating condition, the valve 80 is in the closed position such that transfer of the incompressible fluid 72 between the first and second fluid containment compartments 74, 76 is prevented. Because the fluid 72 is incompressible and fluid tight seals are present between the inner surface 64 and the disc 62 and also the elongate rod 66 and the aperture 54, movement of the piston arrangement 60 is prevented and the arrangement 40 is substantially rigid to enabling it to transmit load.

When the stator vane positioning system and thus the arrangement 40 is subjected to a load which is above a predetermined load, the release means 42 releases so that it is in the second operating condition and can absorb the load. In the second operating condition, the valve 80 is in the open position and thus permits transfer of the incompressible fluid 72 between the first and second fluid containment compartments 74, 76 via the conduit 78. The disc 62 is thus able to move within the housing 44 and transmission of the load between the attachment members 56, 68 is prevented or reduced.

When the arrangement 40 is incorporated into, or constitutes, the actuator control linkage, the load transmitted to the actuator is reduced or eliminated, and the likelihood of damage to the actuator is thereby reduced. When the arrangement 40 is incorporated into, or constitutes, each of the control rods connecting the crankshaft to the actuator rings 28, the load transmitted to the crankshaft, the actuator control linkage and the actuator is reduced or eliminated, and the likelihood of damage to these components is thereby reduced.

The valve 80 is chosen so that it is in the open position only when the load experienced by the arrangement 40 is above a predetermined level, and this will normally be the minimum level at which damage to the components of the stator vane positioning system may occur.

When the load experienced by the arrangement 40 has reduced to less than the predetermined level and the release means 42 returns to the first operating condition, the springs 82, 84, at least one of which will have been compressed as a result of movement of the disc 62, bias the disc 62 back to its original and predetermined equilibrium position, during which movement transfer of the incompressible fluid 72 back along the conduit 78 between the fluid containment compartments 74, 76 will occur. When the disc 62 is in the predetermined position, the valve 80 closes to again prevent transfer of the fluid 72 between the compartments 74, 76 and thereby enable the arrangement 40 to transmit load.

FIG. 4 illustrates a modified load absorption arrangement 140 which is similar to the arrangement 40 and in which corresponding components are given corresponding reference numerals.

The arrangement 140 is designed to replace the actuator of a stator vane positioning system and comprises first and second fluid transfer ducts 143, 144 operable to transfer fluid respectively to and from the first and second fluid containment compartments 74, 76. Each of the ducts 143, 144 is connected to a fuel system of the gas turbine engine 10 and fuel can be injected into or removed from each of the compartments 74, 76. The fuel is incompressible and when the release means 142 is in the first operating condition with the valve 80 in the closed position, transfer of the fuel into or from the compartments via the ducts 143, 144 causes movement of the piston 60 to a desired position. This movement is transmitted via the actuator control linkage, crankshaft and control rods to the actuator rings 28 causing them to rotate and in turn causing rotation of the variable stator vanes 26 to a desired angular position.

Each of the first and second fluid transfer ducts 142, 144 includes a respective valve 146, 148, and the valves are closed when the stator vanes 26 have been set to the desired angular position. A fuel control arrangement is provided to control the valves 146, 148 and transfer of the fuel into and from the respective compartments 74, 76.

The arrangement 140 operates in the same way as the arrangement 40 to absorb loads which are above a predetermined level. However, the release means 142 does not include springs 82, 84 to set the predetermined position of the disc 62, since its position when the release means 142 is in the first operating condition will vary dependent upon the desired angular position of the variable stator vanes 26. Therefore, when the load reduces to below the predetermined level and the release means 142 returns to the first operating condition, the fuel control arrangement operates to reset the piston 60 to the correct position to provide the desired angular position of the variable stator vanes 26.

There is thus provided a load absorption arrangement 40, 140 for absorbing loads in a variable stator vane positioning system of a gas turbine engine 10. The arrangement 40, 140 is compact and lightweight and can be easily incorporated into a variable stator vane positioning system. Moreover, an arrangement 140 can be provided in an existing system by modifying the actuator to include a conduit 78 and a valve 80. An existing actuator can thus be upgraded with relative ease.

Although embodiments of the invention have been described in the preceding paragraphs with reference to various examples, it should be appreciated that various modifications to the examples given may be made without departing from the scope of the present invention, as claimed. For example, a fluid other than oil or fuel may be employed provided that the fluid is incompressible. Resilient members other than springs 82, 84 may be used in the arrangement 40, or alternative means for locating the disc 62 in a predetermined position may be employed. The attachment members 56, 68 may be of a different configuration.

Whilst endeavouring in the foregoing specification to draw attention to those features of the invention believed to be of particular importance, it should be understood that the Applicant claims protection in respect of any patentable feature or combination of features hereinbefore referred to and/or shown in the drawings, whether or not particular emphasis has been placed thereon.

We claim:

1. A load absorption arrangement for absorbing loads in a variable stator vane positioning system, the arrangement comprising:

a piston arrangement within a housing, the housing filled with incompressible fluid;

a release means operable to control the flow of the incompressible fluid from one side of the piston to the other, wherein in a normal operation position the release means prevents the incompressible fluid from flowing from one side of the piston to the other and the piston is held in a fixed position within the housing such that it transmits desired movements to variable stator vanes, wherein in response to a transient load on the piston arrangement exceeding a predetermined threshold the release means will automatically allow the incompressible fluid to flow from one side of the piston to the other, to allow the piston to move freely within the housing, and wherein in response to the transient load falling below the predetermined threshold the release means will automatically return to the normal operation position.

2. An arrangement according to claim 1, wherein the release means comprises a valve.

3. An arrangement according to claim 2, wherein the valve is in a closed position when the release means is in the normal operating condition.

4. An arrangement according to claim 2, wherein the valve is in an open position when the release means is in a second operating condition.

5. An arrangement according to claim 1, wherein the release means includes a fluid transfer conduit.

6. An arrangement according to claim 5, wherein the fluid transfer conduit extends between a first fluid containment compartment and a second fluid containment compartment.

7. An arrangement according to claim 6, wherein the fluid transfer conduit includes a valve.

8. An arrangement according to claim 1, wherein the release means includes positioning means to locate the arrangement in a predetermined position when the release means is in the normal operating condition.

9. An arrangement according to claim 8, wherein the positioning means comprises a resilient means locatable within the fluid containment housing.

10. An arrangement according to claim 5, and in which the release means includes positioning means to locate the arrangement in a predetermined position when the release means is in a first operating condition, and in which the positioning means comprises a resilient means locatable within the fluid containment housing, wherein the resilient means includes a resilient member located within a first fluid containment compartment and operable between the fluid containment housing and the fluid displacement member to bias the fluid displacement member in a first direction.

11. An arrangement according to claim 10, wherein the resilient means includes a further resilient member located within a second fluid containment compartment and operable between the fluid containment housing and the fluid displacement member to bias the fluid displacement member in a second direction, opposite to the first direction.

12. An arrangement according to claim 11, wherein the resilient member and further resilient member abut respectively opposite surfaces of the fluid displacement member.

13. An arrangement according to claim 11, wherein the respective stiffness of the resilient members defines the predetermined position of the arrangement when the release means is in a first operating condition.

14. An arrangement according to claim 11, wherein the resilient member and further resilient member each comprise a spring.

15. A gas turbine engine comprising:

a compressor having a plurality of alternative stages of rotor blades and stator vanes; and a combustor, wherein, stator vanes in a stage of stator vanes of the stages of stator vanes are connected to a load absorption arrangement, the load absorption arrangement having:

a piston arrangement within a housing, the housing filled with incompressible fluid;

a release means operable to control the flow of the incompressible fluid from one side of the piston to the other, wherein in a normal operation position the release means prevents the incompressible fluid from flowing from one side of the piston to the other and the piston is held in a fixed position within the housing such that it can transmit desired movements to variable stator vanes, wherein in response to a transient load on the piston arrangement exceeding a predetermined threshold the release means will automatically allow the incompressible fluid to flow from one side of the piston to the other, to allow the piston to move freely within the housing, and wherein in response to the transient load falling below the predetermined threshold the release means will automatically return to the normal operation position.

16. A gas turbine engine according to claim 15, wherein the gas turbine engine includes a control rod and the control rod comprises the load absorption arrangement.

17. A gas turbine engine according to claim 15, wherein the gas turbine engine includes an actuator and the actuator comprises the load absorption arrangement.

* * * * *